US010977979B1

(12) United States Patent
Xiao et al.

(10) Patent No.: US 10,977,979 B1
(45) Date of Patent: Apr. 13, 2021

(54) GOA CIRCUIT AND DISPLAY PANEL

(71) Applicant: WUHAN CHINA STAR OPTOELECTRONICS TECHNOLOGY CO., LTD., Hubei (CN)

(72) Inventors: Juncheng Xiao, Hubei (CN); Chao Tian, Hubei (CN); Yanqing Guan, Hubei (CN); Yongxiang Zhou, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 0 days.

(21) Appl. No.: 16/965,360

(22) PCT Filed: Jun. 19, 2020

(86) PCT No.: PCT/CN2020/096973

§ 371 (c)(1),
(2) Date: Jul. 28, 2020

(30) Foreign Application Priority Data

Jun. 9, 2020 (CN) ..... 202010519650.2

(51) Int. Cl.
*G09G 3/20* (2006.01)

(52) U.S. Cl.
CPC ..... *G09G 3/20* (2013.01); *G09G 2300/0408* (2013.01); *G09G 2300/08* (2013.01); *G09G 2310/0267* (2013.01); *G09G 2310/0283* (2013.01); *G09G 2310/08* (2013.01); *G09G 2330/027* (2013.01)

(58) Field of Classification Search
CPC ..... G09G 3/20; G09G 2310/0283; G09G 2330/027; G09G 2300/0408; G09G 2310/08; G09G 2310/0267; G09G 2300/08
See application file for complete search history.

(56) References Cited

U.S. PATENT DOCUMENTS

| | | | | |
|---|---|---|---|---|
| 10,302,985 | B1 * | 5/2019 | Gong | H01L 27/1214 |
| 2019/0012973 | A1 * | 1/2019 | Wang | G09G 3/3648 |
| 2019/0130859 | A1 * | 5/2019 | Dai | G11C 19/28 |
| 2019/0156730 | A1 * | 5/2019 | Lim | G09G 3/3677 |
| 2019/0180708 | A1 * | 6/2019 | Hong | G09G 3/20 |
| 2019/0325801 | A1 * | 10/2019 | Xing | G09G 3/20 |
| 2020/0051654 | A1 * | 2/2020 | Wang | G11C 19/28 |
| 2020/0273418 | A1 * | 8/2020 | Zhang | G09G 3/3677 |

* cited by examiner

*Primary Examiner* — Andrew Sasinowski
(74) *Attorney, Agent, or Firm* — Mark M. Friedman

(57) ABSTRACT

A GOA circuit and a display panel are provided. The GOA circuit includes N stage GOA units, and an n-th stage GOA unit comprises a forward scan control module, a reverse scan control module, a pull-up module, a pull-down module, and a function module, wherein 2<n<N−1, and n and N are positive integers. The GOA circuit and the display panel can achieve a narrow frame by simplifying a circuit structure, thereby reducing risks during manufacturing process and stability.

18 Claims, 4 Drawing Sheets

GOA CIRCUIT AND DISPLAY PANEL

BACKGROUND OF INVENTION

Field of Invention

The present application relates to the field of display technology, specifically, to a touch panel and a GOA circuit and display panel.

Description of Prior Art

GOA (English full name: Gate Driver on Array, Chinese full name: integrated gate drive circuit) technology integrates a gate driving circuit on an array substrate of a display panel, which can conserve part of a gate driving circuit, thus reducing both material and manufacturing costs. However, a structure of an existing GOA circuit is more complicated, which is not conducive to layout design, and makes it difficult to achieve a narrow border.

SUMMARY OF INVENTION

The purpose of an embodiment of the present application is to provide a GOA circuit and a display panel, which can solve the technical problem that the structure of an existing GOA circuit is more complicated, which is not conducive to layout design, and it is difficult to achieve a narrow border.

The embodiment of the present application provides a gate driver on array (GOA) circuit, comprising N stage GOA units, and an n-th stage GOA unit comprises a forward scan control module, a reverse scan control module, a pull-up module, a pull-down module, and a function module, wherein $2<n<N-1$, and n and N are positive integers;

the forward scan control module is connected to a forward signal, an (n+1)th stage clock signal and an (n−2)th stage scan signal, and is electrically connected to a first node and a second node; the forward scan control module is configured to raise a potential of the first node and control a potential of the second node according to the forward signal, the (n+1)th stage clock signal, and the (n−2)th stage scan signal;

the reverse scan control module is connected to a reverse signal, an (n−1)th stage clock signal and an (n+2)th stage scan signal, and is electrically connected to the first node and the second node; the reverse scan control module is configured to raise the potential of the first node and control the potential of the second node according to the reverse signal, the (n−1)th stage clock signal, and the (n+2)th stage scan signal;

the pull-up module is connected to a constant-voltage low-level signal, a constant-voltage high-level signal, and an n-th stage clock signal, and is electrically connected to the first node and a scan signal output end; the pull-up module is configured to control a potential of the scan signal output end according to the constant-voltage low-level signal, the constant-voltage high-level signal, the n-th clock signal, and the potential of the first node;

the pull-down module is connected to the constant-voltage high-level signal and the constant-voltage low-level signal, and is electrically connected to the first node, the second node, and the scan signal output end; the pull-down module is configured to pull down the potential of the first node and the potential of the scan signal output end according to the constant-voltage high-level signal, the constant-voltage low-level signal, and the potential of the second section;

the function module is connected to a first function control signal, a second function control signal, a third function control signal, and a fourth function control signal, and is electrically connected to the pull-down module and the scan signal output end; the function module is configured to control the potential of the first node and the potential of the scan signal output end according to the first function control signal, the second function control signal, the third function control signal and the fourth function control signal.

In the GOA circuit described in the application, the forward scan control module comprises a first transistor and a third transistor;

a gate of the first transistor is electrically connected to the (n−2)th scan signal, and a source of the first transistor is electrically connected to the forward scan signal and a gate of the third transistor, a drain of the first transistor is electrically connected to the first node, a source of the third transistor is electrically connected to the (n+1)th stage clock signal, and a drain of the third transistor is electrically connected to the second node.

In the GOA circuit described in the application, he reverse scan control module comprises a second transistor and a fourth transistor;

a gate of the second transistor is electrically connected to the (n+2)th scan signal, and a source of the second transistor is electrically connected to the reverse scan signal and a gate of the fourth transistor, a drain of the second transistor is electrically connected to the first node, a source of the fourth transistor is electrically connected to the (n−1)th stage clock signal, and a drain of the fourth transistor is electrically connected to the second node.

In the GOA circuit described in the application, the pull-up module comprises a seventh transistor, a ninth transistor, and a first capacitor;

a gate of the seventh transistor is electrically connected to the constant-voltage high-level signal, a source of the seventh transistor is electrically connected to the first node, and a drain of the seventh transistor is electrically connected to a gate of the ninth transistor, the gate of the ninth transistor is electrically connected to the n-th clock signal, and the gate of the ninth transistor is electrically connected to the scan signal output end; one end of the first capacitor is electrically connected to the first node, and another end of the first capacitor is electrically connected to the constant-voltage low-level signal.

In the GOA circuit described in the application, the pull-down module comprises a fifth transistor, a sixth transistor, an eighth transistor, a tenth transistor, and a second capacitor;

a gate of the fifth transistor, a drain of the sixth transistor, a drain of the eighth transistor, a gate of the tenth transistor, and one end of the second capacitor are all electrically connected to a third node; a source of the fifth transistor, a source of the sixth transistor, a source of the tenth transistor, and another end of the second capacitor are all electrically connected to the constant-voltage low-level signal; a drain of the fifth transistor and a gate of the sixth transistor are both electrically connected to the first node; a gate of the eighth transistor is electrically connected to the second node, a source of the eight transistors is electrically connected to the constant-voltage high-level signal, and a drain of the tenth transistor is electrically connected to the scan signal output end.

In the GOA circuit described in the application, the functional module comprises an eleventh transistor and a twelfth transistor;

a gate of the eleventh transistor is electrically connected to the first function control signal, a source of the eleventh transistor is electrically connected to the third function control signal, and a drain of the eleventh transistor is electrically connected to the third node;

a gate of the twelfth transistor is electrically connected to the second function control signal, a source of the twelfth transistor is electrically connected to the fourth function control signal, and a drain of the twelfth transistor is electrically connected to the scan signal output end.

In the GOA circuit described in the application, the GOA circuit has a reset mode, an abnormal power-off mode, and a full shutdown mode;

when the GOA circuit is in the reset mode, the first function control signal and the third function control signal are at a high potential;

when the GOA circuit is in the abnormal power-off mode, the first function control signal, the second function control signal, and the fourth function control signal are all at the high potential, and the third function control signal is at a low potential;

when the GOA circuit is in the full-off mode, the second function control signal is at the high potential, and the fourth function control signal is at the low potential.

In the GOA circuit described in the application, the GOA circuit accesses a first clock signal, a second clock signal, a third clock signal, and a fourth clock signal;

the (4k+1)th stage clock signal and the first clock signal are the same signal, the (4k+2)th stage clock signal and the second clock signal are the same signal, the (4k+3)th stage clock signal and the third clock signal are the same signal, the (4k+4)th stage clock signal and the fourth clock signal are the same signal, wherein k is greater than or equal to 0, and k is an integer.

In the GOA circuit described in the application, the GOA circuit accesses a first start signal and a second start signal;

when the GOA circuit is in the forward scanning mode, the first-stage GOA unit accesses the first start signal, and the second-stage GOA unit accesses the second start signal;

when the GOA circuit is in the reverse scan mode, the GOA unit of an Nth stage accesses the first start signal, and the GOA unit of the (N−1)th stage accesses the second start signal.

The embodiment of the present application also provides a display panel, comprising a GOA circuit, the GOA circuit comprises N stage GOA units, and a n-th stage GOA unit comprises a forward scan control module, a reverse scan control module, a pull-up module, a pull-down module, and a function module, wherein $2<n<N-1$, and n and N are positive integers;

the forward scan control module is connected to a forward signal, an (n+1)th stage clock signal and an (n−2)th stage scan signal, and is electrically connected to a first node and a second node; the forward scan control module is configured to raise a potential of the first node and control a potential of the second node according to the forward signal, the (n+1)th stage clock signal, and the (n−2)th stage scan signal;

the reverse scan control module is connected to a reverse signal, an (n−1)th stage clock signal and an (n+2)th stage scan signal, and is electrically connected to the first node and the second node; the reverse scan control module is configured to raise the potential of the first node and control the potential of the second node according to the reverse signal, the (n−1)th stage clock signal, and the (n+2)th stage scan signa;

the pull-up module is connected to a constant-voltage low-level signal, a constant-voltage high-level signal, and an n-th stage clock signal, and is electrically connected to the first node and a scan signal output end; the pull-up module is configured to control a potential of the scan signal output end according to the constant-voltage low-level signal, the constant-voltage high-level signal, the n-th clock signal, and the potential of the first node;

the pull-down module is connected to the constant-voltage high-level signal and the constant-voltage low-level signal, and is electrically connected to the first node, the second node, and the scan signal output end; the pull-down module is configured to pull down the potential of the first node and the potential of the scan signal output end according to the constant-voltage high-level signal, the constant-voltage low-level signal, and the potential of the second section;

the function module is connected to a first function control signal, a second function control signal, a third function control signal, and a fourth function control signal, and is electrically connected to the pull-down module and the scan signal output end; the function module is configured to control the potential of the first node and the potential of the scan signal output end according to the first function control signal, the second function control signal, the third function control signal and the fourth function control signal.

In the display panel described in the application, the forward scan control module comprises a first transistor and a third transistor;

a gate of the first transistor is electrically connected to the (n−2)th scan signal, and a source of the first transistor is electrically connected to the forward scan signal and a gate of the third transistor, a drain of the first transistor is electrically connected to the first node, a source of the third transistor is electrically connected to the (n+1)th stage clock signal, and a drain of the third transistor is electrically connected to the second node.

In the display panel described in the application, the reverse scan control module comprises a second transistor and a fourth transistor;

a gate of the second transistor is electrically connected to the (n+2)th scan signal, and a source of the second transistor is electrically connected to the reverse scan signal and a gate of the fourth transistor, a drain of the second transistor is electrically connected to the first node, a source of the fourth transistor is electrically connected to the (n−1)th stage clock signal, and a drain of the fourth transistor is electrically connected to the second node.

In the display panel described in the application, the pull-up module comprises a seventh transistor, a ninth transistor, and a first capacitor;

a gate of the seventh transistor is electrically connected to the constant-voltage high-level signal, a source of the seventh transistor is electrically connected to the first node, and a drain of the seventh transistor is electrically connected to a gate of the ninth transistor, the gate of the ninth transistor is electrically connected to the n-th clock signal, and the gate of the ninth transistor is electrically connected to the scan signal output end; one end of the first capacitor is electrically connected to the first node, and another end of the first capacitor is electrically connected to the constant-voltage low-level signal.

In the display panel described in the application, the pull-down module comprises a fifth transistor, a sixth transistor, an eighth transistor, a tenth transistor, and a second capacitor;

a gate of the fifth transistor, a drain of the sixth transistor, a drain of the eighth transistor, a gate of the tenth transistor, and one end of the second capacitor are all electrically connected to a third node; a source of the fifth transistor, a source of the sixth transistor, a source of the tenth transistor, and another end of the second capacitor are all electrically connected to the constant-voltage low-level signal; a drain of the fifth transistor and a gate of the sixth transistor are both electrically connected to the first node; a gate of the eighth transistor is electrically connected to the second node, a source of the eight transistors is electrically connected to the constant-voltage high-level signal, and a drain of the tenth transistor is electrically connected to the scan signal output end.

In the display panel described in the application, the functional module comprises an eleventh transistor and a twelfth transistor;

a gate of the eleventh transistor is electrically connected to the first function control signal, a source of the eleventh transistor is electrically connected to the third function control signal, and a drain of the eleventh transistor is electrically connected to the third node;

a gate of the twelfth transistor is electrically connected to the second function control signal, a source of the twelfth transistor is electrically connected to the fourth function control signal, and a drain of the twelfth transistor is electrically connected to the scan signal output end.

In the display panel described in the application, the GOA circuit has a reset mode, an abnormal power-off mode, and a full shutdown mode;

when the GOA circuit is in the reset mode, the first function control signal and the third function control signal are at a high potential;

when the GOA circuit is in the abnormal power-off mode, the first function control signal, the second function control signal, and the fourth function control signal are all at the high potential, and the third function control signal is at a low potential;

when the GOA circuit is in the full-off mode, the second function control signal is at the high potential, and the fourth function control signal is at the low potential.

In the display panel described in the application, the GOA circuit accesses a first clock signal, a second clock signal, a third clock signal, and a fourth clock signal;

the (4k+1)th stage clock signal and the first clock signal are the same signal, the (4k+2)th stage clock signal and the second clock signal are the same signal, the (4k+3)th stage clock signal and the third clock signal are the same signal, the (4k+4)th stage clock signal and the fourth clock signal are the same signal, wherein k is greater than or equal to 0, and k is an integer.

In the display panel described in the application, the GOA circuit accesses a first start signal and a second start signal;

when the GOA circuit is in the forward scanning mode, the first-stage GOA unit accesses the first start signal, and the second-stage GOA unit accesses the second start signal;

when the GOA circuit is in the reverse scan mode, the GOA unit of an Nth stage accesses the first start signal, and the GOA unit of the (N−1)th stage accesses the second start signal.

The GOA circuit and the display panel provided in the embodiment of the present application can achieve a narrow frame by simplifying the circuit structure, thereby reducing the risk of manufacturing process and stability.

BRIEF DESCRIPTION OF DRAWINGS

In order to more clearly explain the technical solutions in the embodiments of the present application, the following will briefly introduce the drawings required in the description of the embodiments. Obviously, the drawings in the following description are only some embodiments of the present application. For those skilled in the art, without paying any creative work, other drawings can be obtained based on these drawings.

DETAILED DESCRIPTION OF PREFERRED EMBODIMENTS

Figure 1:
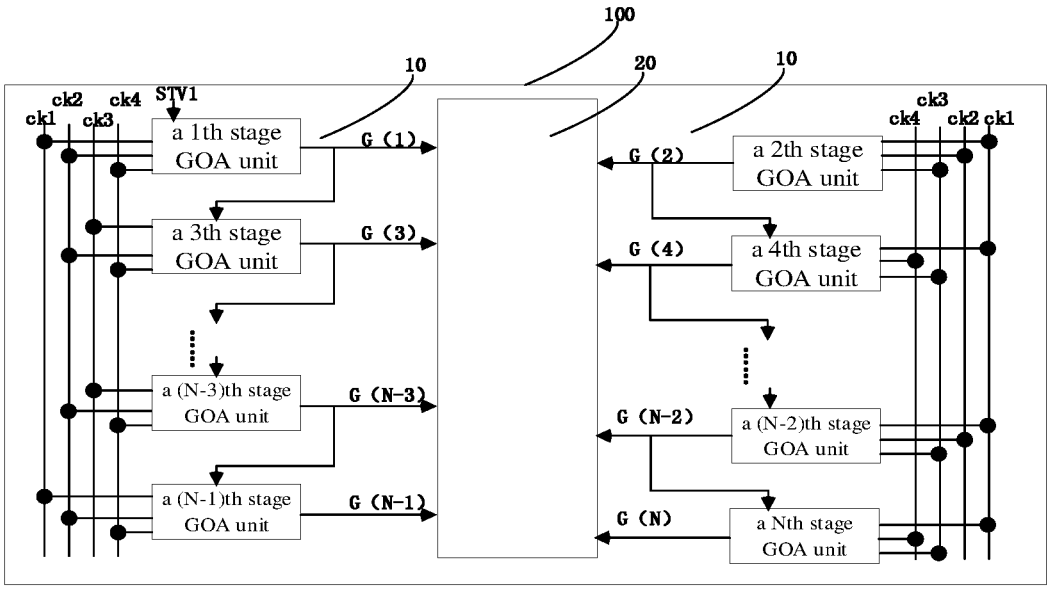
FIG. 1 is a schematic structural diagram of a display panel provided by an embodiment of this application.

The technical solutions in the embodiments of the present application will be described clearly and completely with reference to the drawings in the embodiments of the present application. Obviously, the described embodiments are only a part of the embodiments of the present application, but not all the embodiments. Based on the embodiments in the present application, all other embodiments obtained by those skilled in the art without making creative work fall within the protection scope of the present application.

The transistors used in all the embodiments of the present application may be thin film transistors, field effect transistors or other devices with the same characteristics. Since the source and drain of the transistor used here are symmetrical, the source and drain can be interchanged of. In the embodiment of the present application, in order to distinguish the two electrodes of the transistor except the gate, one of the electrodes is called a source electrode, and the other electrode is called a drain electrode. According to the form in the drawing, the middle end of the switching transistor is a gate, the signal input end is a source, and the output end is a drain. In addition, the transistors used in the embodiments of the present application are all N-type transistors or P-type transistors, where the N-type transistor is turned on when the gate is at a high level and is turned off when the gate is at a low level; the P-type transistor is at a low gate Turns on when the level is high and turns off when the gate is high.

Please refer to FIG. 1, which is a schematic structural diagram of a display panel provided by an embodiment of the present application. As shown in FIG. 1, the display panel 100 provided by the embodiment of the present application comprises a display area 20 and a GOA circuit area 10 provided outside the display area 20. The display area 20 is provided with a plurality of scanning lines, a plurality of data lines, and a plurality of sub-pixel units defined by an intersection of the plurality of scanning lines and the plurality of data lines. The GOA circuit area 10 is provided with a GOA circuit. The GOA circuit comprises N stage GOA units. The GOA units are connected in corresponding one-to-one with the scanning lines, that is, the number of the GOA units is equal to the number of the scanning lines.

Wherein, the GOA circuit comprises multiple cascaded odd-stage GOA units and even-stage GOA units. The multiple cascaded odd-stage GOA units are provided on one side of the display area 20, and the multiple cascaded even-stage GOA units are provided on another side of the display area 20.

For example, when N is even, a 1st stage GOA unit, a 3rd stage GOA unit, a 5th stage GOA unit, . . . , follow an (N−1)th stage GOA unit cascade setting, and a 2nd stage GOA unit, a 4th stage GOA unit, a 6th stage GOA unit, . . . , follow an Nth stage GOA unit cascade setting. It should be noted that, in the embodiment of the present application, N may be an even number or an odd number, which is not limited herein.

Wherein, the GOA circuit is connected to a first clock signal ck1, a second clock signal ck2, a third clock signal ck3, a fourth clock signal ck4, a first start signal STV1 and a second start signal STV2. Specifically, the multiple cascaded odd-stage GOA units is connected to the first clock signal ck1, the second clock signal ck2, the third clock signal ck3, the fourth clock signal ck4, and the first start signal STV1. The multiple cascaded even-stage GOA units is connected to the first clock signal ck1, the second clock signal ck2, the third clock signal ck3, the fourth clock signal ck4, and the second start signal STV2.

Figure 2:
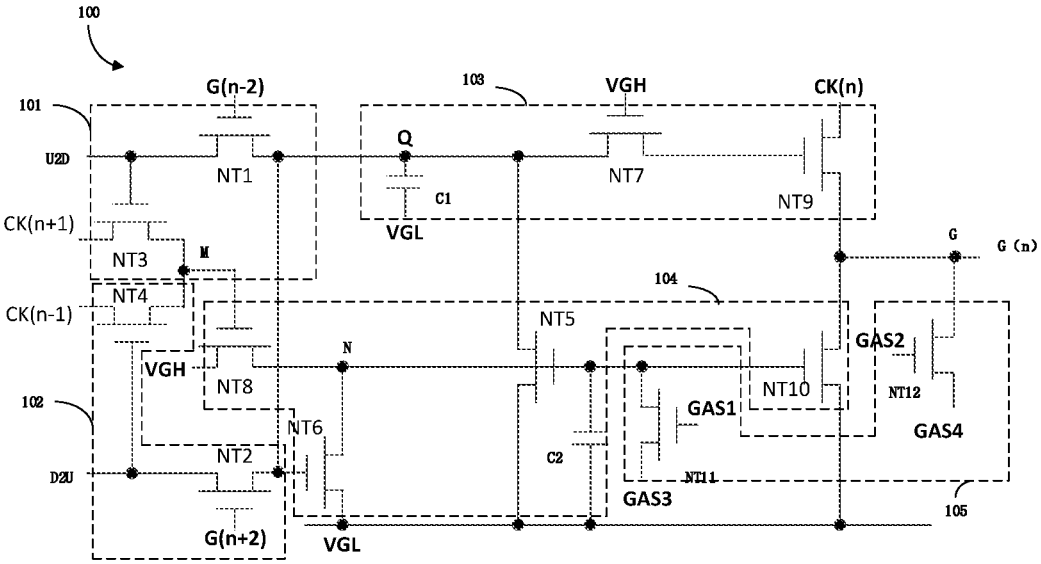
FIG. 2 is a first schematic circuit diagram of a GOA unit in a GOA circuit provided by an embodiment of this application.

Further, please refer to FIG. 2, which is a first schematic circuit diagram of the GOA unit in the GOA circuit provided by the embodiment of the present application. With reference to FIGS. 1 and 2, in the GOA circuit provided by the embodiment of the present application, the n-th stage GOA unit 100 comprises a forward scan control module 101, a reverse scan control module 102, a pull-up module 103, a pull-down module 104, and function module 105, wherein 2<n<N−1, and n and N are positive integers.

Wherein, the forward scan control module 101 accesses a forward signal U2D, an (n+1)th stage clock signal CK(n+1) and an (n−2)th stage scan signal G(n−2), and is electrically connected to a first node Q and a second node M. The forward scan control module 101 is configured to raise a potential of the first node Q and control a potential of the second node M according to the forward signal U2D, the (n+1)th stage clock signal CK(n+1) and the (n−2)th stage scan signal G(n−2).

Wherein, the reverse scan control module 102 accesses a reverse signal D2U, a (n−1)th stage clock signal CK(n−1) and a (n+2)th stage scan signal G(n+2), and is electrically connected to the first node Q and the second node M. The reverse scan control module 102 is configured to raise the potential of the first node Q and control the potential of the second node M according to the reverse signal D2U, the (n−1)th stage clock signal CK(n−1) and the (n+2)th stage scan signal G(n+2).

Wherein, the pull-up module 103 accesses a constant-voltage low-level signal VGL, a constant-voltage high-level signal VGH, and a n-th level clock signal CK(n), and is electrically connected to the first node Q and a scan signal output end G. The pull-up module 103 is configured to control a potential of the scan signal output end G according to the constant-voltage low-level signal VGL, the constant-voltage high-level signal VGH, the n-th level clock signal CK(n), and the potential of the first node Q.

Wherein, the pull-down module 104 accesses the constant-voltage high-level signal VGH and the constant-voltage low-level signal VGL, and is electrically connected to the first node Q, the second node M, and the scan signal output end G. The pull-down module 104 is configured to pull down the potential of the first node Q and the potential of the scan signal output end G according to the constant-voltage high-level signal VGH, the constant-voltage low-level signal VGL, and the potential of the second section.

Wherein, the function module 105 accesses a first function control signal GAS1, a second function control signal GAS2, a third function control signal GAS3, and a fourth function control signal GAS4, and is electrically connected to the pull-down module 104 and the scan signal output end G. The function module 105 is configured to control the potential of the first node Q and the potential of the scan signal output end G according to the first function control signal GAS1, the second function control signal GAS2, the third function control signal GAS3, and the fourth function control signal GAS4.

It should be noted that the (4k+1)th stage clock signal CK (4k+1) and the first clock signal ck1 are the same signal, the (4k+2)th stage clock signal CK (4k+2) and the second clock signal ck2 are the same signal, the (4k+3)th stage clock signal CK(4k+3) and the third clock signal ck3 are the same signal, and the (4k+4)th stage clock signal CK(4k+4) and the fourth clock signal ck4 are the same signal, wherein k is greater than or equal to 0, and k is an integer.

For example, the 1th stage clock signal CK(1), the 5th stage clock signal CK(5), the 9th stage clock signal CK(9), . . . the (4k+1)th stage clock signal CK(4k+1), and the first clock signal ck1 are all the same signal. The 2th stage clock signal CK(2), the 6th stage clock signal CK(6), the 10th stage clock signal CK(10), . . . the (4k+2)th stage clock signal CK(4k+2), and the second clock signal ck2 are all the same signal. The 3th stage clock signal CK(3), the 7th stage clock signal CK(7), the 11th stage clock signal CK(11), . . . the (4k+3)th stage clock signal CK(4k+3), and the third clock signal ck1 are all the same signal. The 4th stage clock signal CK(4), the 8th stage clock signal CK(8), the 12th stage clock signal CK(12), . . . the (4k+4)th stage clock signal CK(4k+3), and the fourth clock signal ck4 are all the same signal.

In some embodiments, the forward scan control module 101 comprises a first transistor NT1 and a third transistor NT3; a gate of the first transistor NT1 is electrically connected to the (n−2)th scan signal G(n−2), a source of the first transistor NT1 is electrically connected to the forward scan signal U2D and a gate of the third transistor NT3, a drain of the first transistor NT1 is electrically connected to the first node Q, a source of the third transistor NT3 is electrically connected to the (n+1)th level clock signal CK(n+1), and a drain of the third transistor NT3 is electrically connected to the second node M.

In some embodiments, the reverse scan control module 102 comprises a second transistor NT2 and a fourth transistor NT4; a gate of the second transistor NT2 is electrically connected to the (n+2)th scan signal G(n+2), a source of the second transistor NT2 is electrically connected to the reverse scan signal D2U and a gate of the fourth transistor NT4, a drain of the second transistor NT2 is electrically connected to the first node Q, a source of the fourth transistor NT4 is electrically connected to the (n−1)th stage clock signal CK(n−1), and a drain of the fourth transistor NT4 is electrically connected to the second node M.

In some embodiments, the pull-up module 103 comprises a seventh transistor NT7, a ninth transistor NT9, and a first capacitor C1; a gate of the seventh transistor NT7 is electrically connected to the constant-voltage high-level signal VGH, a source of the seventh transistor NT7 is electrically connected to the first node Q, and a drain of the seventh transistor NT7 is electrically connected to a gate of the ninth transistor NT9, the gate of the ninth transistor NT9 is electrically connected to the n-th clock signal CK(n), and the gate of the ninth transistor NT9 is electrically connected to the scan signal output end G; one end of the first capacitor C1 is electrically connected to the first node Q, and another end of the first capacitor C1 is electrically connected to the constant-voltage low-level signal VGL.

In some embodiments, the pull-down module 104 comprises a fifth transistor NT5, a sixth transistor NT6, an eighth transistor NT8, a tenth transistor NT10, and a second capacitor C2; a gate of the fifth transistor NT5, a drain of the sixth transistor NT6, a drain of the eighth transistor NT8, a gate of the tenth transistor NT10, and one end of the second capacitor C2 are all electrically connected to a third node N; a source of the fifth transistor NT5, a source of the sixth transistor NT6, a source of the tenth transistor NT10, and another end of the second capacitor C2 are all electrically connected to the constant-voltage low-level signal VGL; a drain of the fifth transistor NT5 and a gate of the sixth transistor NT6 are both electrically connected to the first node Q; a gate of the eighth transistor NT8 is electrically connected to the second node M, a source of the eighth transistor NT8 is electrically connected to the constant-voltage high-level signal VGH, and a drain of the tenth transistor NT10 is electrically connected to the scan signal output end G.

In some embodiments, the functional module 105 comprises an eleventh transistor NT11 and a twelfth transistor NT12; a gate of the eleventh transistor NT11 is electrically connected to the first function control signal GAS1, a source of the eleventh transistor NT11 is electrically connected to the third function control signal GAS3, and a drain of the eleventh transistor NT11 is electrically connected to the third node N, a gate of the twelfth transistor NT12 is electrically connected to the second function control signal GAS2, a source of the twelfth transistor NT12 is electrically connected to the fourth function control signal GAS4, and a drain of the twelfth transistor NT12 is electrically connected to the scan signal output end G.

In addition, the GOA circuit provided by the embodiment of the present application may be in a forward scan mode or a reverse scan mode. When the GOA circuit is in the forward scan mode, in the multiple cascaded odd-stage GOA units, the GOA circuit starts sequentially from the 1th stage GOA unit to the (N−1)th stage GOA unit; in the multiple cascaded eve-stage GOA units, the GOA circuit starts sequentially from the 2th stage GOA unit to the Nth stage GOA unit. When the GOA circuit is in reverse scan mode, in the multiple cascaded odd-stage GOA units, the GOA circuit starts sequentially from the (N−1)th stage GOA unit to the 1st stage GOA unit; in the multiple cascaded eve-stage GOA units, the GOA circuit starts sequentially from the Nth stage GOA unit to the 2th stage GOA unit.

In one embodiment, when the GOA circuit is in the forward scan mode, the 1th stage GOA unit accesses the first start signal STV1, and the 2th stage GOA unit accesses the second start signal SYV2. In addition, the circuit schematic diagrams of the (N−1)th stage GOA unit and the Nth stage GOA unit can be referred to FIG. 2, which will not be repeated here.

Figure 3:
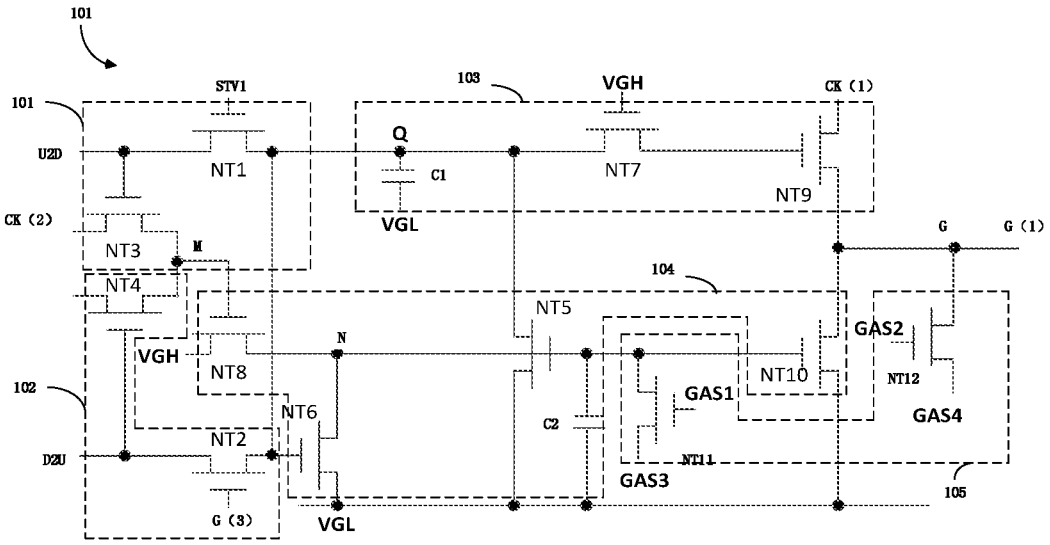
FIG. 3 is a second schematic circuit diagram of a GOA unit in a GOA circuit provided by an embodiment of this application.

Specifically, please refer to FIG. 3, which is a second schematic circuit diagram of the GOA unit in the GOA circuit provided by the embodiment of the present application. As shown in FIG. 3, when the GOA circuit is in the forward scan mode, the difference between the 1th stage GOA unit and the nth GOA unit is that the gate of the first transistor NT1 in the 1th stage GOA unit is electrically connected to the first start signal STV1, and the source of the fourth transistor NT4 is not connected to anything.

Figure 4:
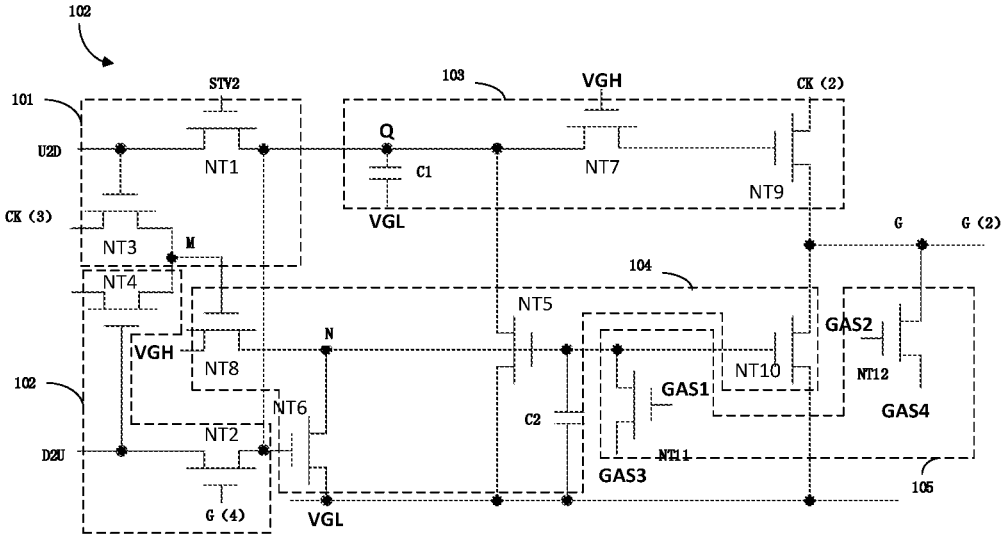
FIG. 4 is a third schematic circuit diagram of a GOA unit in a GOA circuit provided by an embodiment of this application.

Specifically, please refer to FIG. 4, which is a third schematic circuit diagram of the GOA unit in the GOA circuit provided by the embodiment of the present application. As shown in FIG. 4, when the GOA circuit is in the forward scan mode, the difference between the 2th stage GOA unit and the nth stage GOA is that the gate of the first transistor NT1 in the 2th stage GOA unit is electrically connected to the second start signal STV2, and the source of the fourth transistor NT4 is not connected to anything.

In another embodiment, when the GOA circuit is in the reverse scan mode, the Nth stage GOA unit accesses the first start signal STV1, and the (N−1)th stage GOA unit accesses the second start signal STV2. In addition, the circuit schematic diagrams of the 2th stage GOA unit and the 1th stage GOA unit can be referred to FIG. 2 and will not be repeated here.

Figure 5:
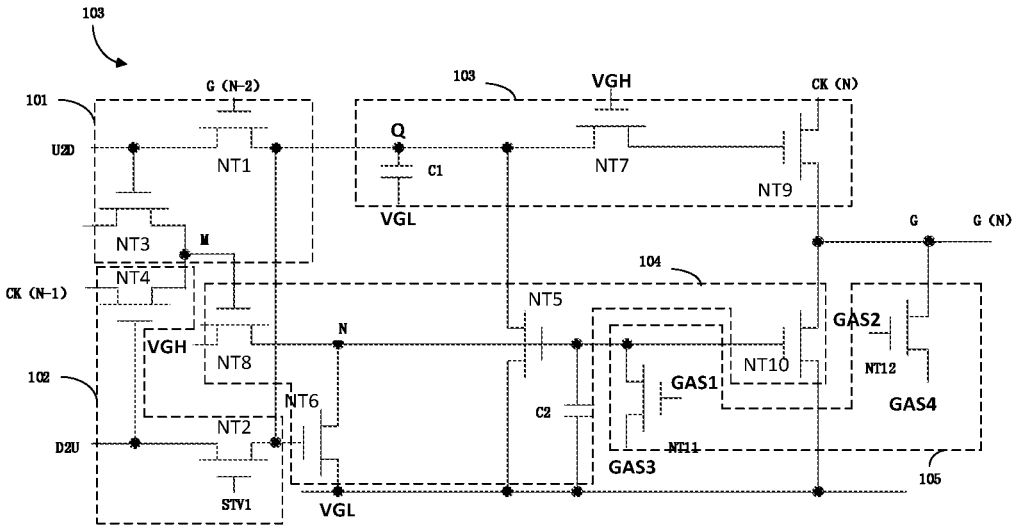
FIG. 5 is a fourth schematic circuit diagram of a GOA unit in a GOA circuit provided by an embodiment of this application.

Specifically, please refer to FIG. 5, which is a fourth schematic circuit diagram of the GOA unit in the GOA circuit provided by the embodiment of the present application. As shown in FIG. 5, when the GOA circuit is in the reverse scan mode, the difference between the Nth stage GOA unit and the nth stage GOA unit is that the gate of the second transistor NT2 in the Nth stage GOA unit is electrically connected to the first start signal STV1, the source of the third transistor NT3 is empty.

Figure 6:
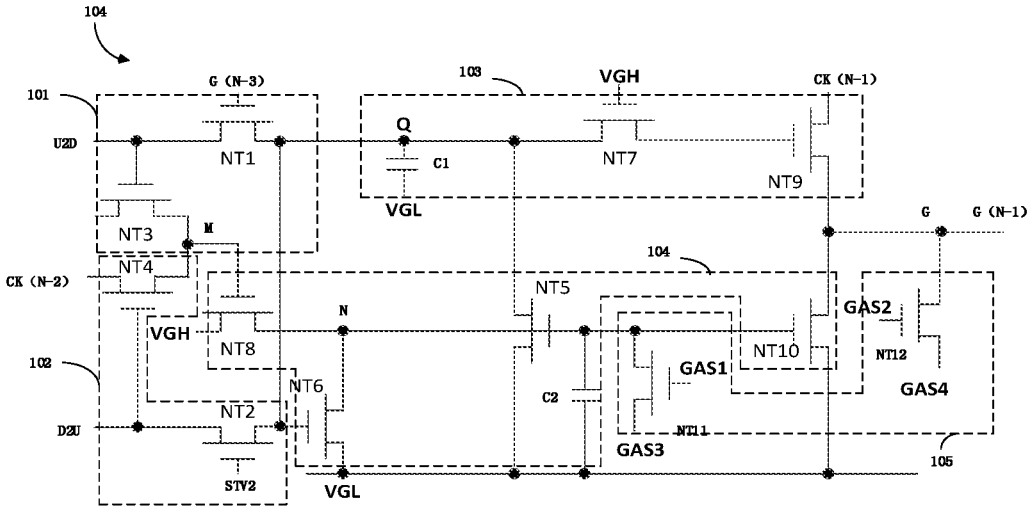
FIG. 6 is a fifth schematic circuit diagram of a GOA unit in a GOA circuit provided by an embodiment of this application.

Specifically, please refer to FIG. 6, which is a fifth schematic circuit diagram of the GOA unit in the GOA circuit provided by the embodiment of the present application. As shown in FIG. 6, when the GOA circuit is in the reverse scanning mode, the difference between the (N−1)th stage GOA unit and the nth stage GOA unit is that: the gate electrical property of the second transistor NT2 in the (N−1)th stage GOA unit is electrically connected to the second start signal STV2, and the source of the third transistor NT3 is empty.

Figure 7:
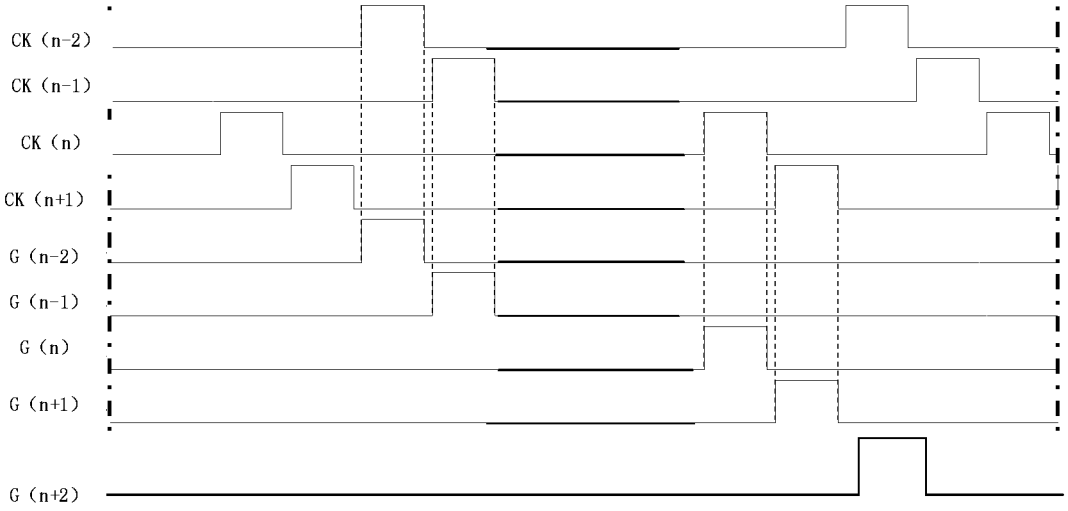
FIG. 7 is a signal timing diagram of the GOA unit shown in FIG. 2.

The GOA circuit is in the forward scan mode as an example for description. When the GOA circuit is in the forward scan mode, the forward signal U2D is at the high level and the reverse signal D2U is at the low level. Please refer to FIGS. 2 and 7. FIG. 7 is a signal timing diagram of the GOA unit shown in FIG. 2. With reference to FIGS. 2 and 3, when the (n−2)th stage scan signal G(n−2) is high and the n-th clock signal CK(n) is high, the first transistor NT1, the seventh transistor NT7 and the ninth transistor NT9 are turned on, and the scan signal output end G outputs a high potential, that is, the n-th scan signal G(n) is at the high potential. Subsequently, when the (n+1)th stage clock signal CK(n+1) is at the high potential, the third transistor NT3, the eighth transistor NT8, the fifth transistor NT5, and the tenth transistor NT10 are all turned on, and the constant-voltage low-level signal VGL is output to the first node Q through the fifth transistor NT5, and the constant-voltage low-level signal VGL is output to the scan signal output end G through the tenth transistor NT10, that is, the potential of the first node Q and the potential of the scan signal G(n) are both pulled down. Finally, the (n+2)th stage scan signal G(n+2) is at the high potential, the second transistor NT2 is turned on, and the reverse signal D2U is output to the first node Q to maintain the first node Q at a low potential.

Further, the GOA circuit has a reset mode, an abnormal power-off mode, and a full shutdown mode. When the GOA circuit is in the reset mode, the first function control signal GAS1 and the third function control signal GAS3 are high potential. When the GOA circuit is in the abnormal power-off mode, the first function control signal GAS1, the second function control signal GAS2, and the fourth function control signal GAS4 are all high potential, and the third function control signal GAS3 is low potential. When the GOA circuit is in the fully off mode, the second function control signal GAS2 is at a high potential, and the fourth function control signal GAS4 is at a low potential.

Specifically, when the GOA circuit is in the reset mode, the first function control signal GAS1 and the third function control signal GAS3 are at high potential, and the eleventh transistor NT11 is turned on. At this time, the potential of the third node N is high, making the fifth transistor NT5 turn on, and the potential of the first node Q is pulled down, thereby resetting the first node Q.

When the GOA circuit is in the abnormal power-off mode, the first function control signal GAS1, the second function control signal GAS2, and the fourth function control signal GAS4 are all at high potential, the third function control signal GAS3 is at low potential, and the eleventh transistor NT11 is turned on, at this time, the potential of the third node N is the potential; meanwhile, the twelfth transistor NT12 is turned on, and the scan signal G(n) output from the scan signal output end G is at high potential, so that when the GOA circuit is abnormally powered off, the GOA circuit can still continue to work.

When the GOA circuit is in the full-off mode, the second function control signal GAS2 is at high potential, the fourth function control signal GAS4 is at low potential, the twelfth transistor NT12 is turned on, and the scan signal G(n) output from the scan signal output end G is at low potential, so as to realize the full shutdown mode of the GOA circuit, that is, the scan signal output by each GOA unit is at low potential.

The GOA circuit and the display panel provided in the embodiment of the present application can achieve a narrow frame by simplifying the circuit structure, thereby reducing the risk of manufacturing process and stability.

The above are only the embodiments of the present application, and therefore do not limit the patent scope of the present invention. Any equivalent structure or equivalent process transformation made by using the description and drawings of the present invention, or directly or indirectly used in other related technical fields, The same reason is included in the scope of patent protection of the present invention.

What is claimed is:

1. A gate driver on array (GOA) circuit, comprising N stage GOA units, and an n-th stage GOA unit comprises a forward scan control module, a reverse scan control module, a pull-up module, a pull-down module, and a function module, wherein $2<n<N-1$, and n and N are positive integers;

the forward scan control module is connected to a forward signal, an (n+1)th stage clock signal and an (n−2)th stage scan signal, and is electrically connected to a first node and a second node; the forward scan control module is configured to raise a potential of the first node and control a potential of the second node according to the forward signal, the (n+1)th stage clock signal, and the (n−2)th stage scan signal;

the reverse scan control module is connected to a reverse signal, an (n−1)th stage clock signal and an (n+2)th stage scan signal, and is electrically connected to the first node and the second node; the reverse scan control module is configured to raise the potential of the first node and control the potential of the second node according to the reverse signal, the (n−1)th stage clock signal, and the (n+2)th stage scan signal;

the pull-up module is connected to a constant-voltage low-level signal, a constant-voltage high-level signal, and an n-th stage clock signal, and is electrically connected to the first node and a scan signal output end; the pull-up module is configured to control a potential of the scan signal output end according to the constant-voltage low-level signal, the constant-voltage high-level signal, the n-th clock signal, and the potential of the first node;

the pull-down module is connected to the constant-voltage high-level signal and the constant-voltage low-level signal, and is electrically connected to the first node, the second node, and the scan signal output end; the pull-down module is configured to pull down the potential of the first node and the potential of the scan signal output end according to the constant-voltage high-level signal, the constant-voltage low-level signal, and the potential of the second section; and the function module is connected to a first function control signal, a second function control signal, a third function control signal, and a fourth function control signal, and is electrically connected to the pull-down module and the scan signal output end; the function module is configured to control the potential of the first node and the potential of the scan signal output end according to the first function control signal, the second function control signal, the third function control signal and the fourth function control signal.

2. The GOA circuit of claim 1, wherein the forward scan control module comprises a first transistor and a third transistor;

a gate of the first transistor is electrically connected to the (n−2)th scan signal, and a source of the first transistor is electrically connected to the forward scan signal and a gate of the third transistor, a drain of the first transistor is electrically connected to the first node, a source of the third transistor is electrically connected to the (n+1)th stage clock signal, and a drain of the third transistor is electrically connected to the second node.

3. The GOA circuit of claim 1, wherein the reverse scan control module comprises a second transistor and a fourth transistor;

a gate of the second transistor is electrically connected to the (n+2)th scan signal, and a source of the second transistor is electrically connected to the reverse scan signal and a gate of the fourth transistor, a drain of the second transistor is electrically connected to the first node, a source of the fourth transistor is electrically connected to the (n−1)th stage clock signal, and a drain of the fourth transistor is electrically connected to the second node.

4. The GOA circuit of claim 1, wherein the pull-up module comprises a seventh transistor, a ninth transistor, and a first capacitor;

a gate of the seventh transistor is electrically connected to the constant-voltage high-level signal, a source of the seventh transistor is electrically connected to the first node, and a drain of the seventh transistor is electrically connected to a gate of the ninth transistor, the gate of the ninth transistor is electrically connected to the n-th clock signal, and the gate of the ninth transistor is electrically connected to the scan signal output end; one end of the first capacitor is electrically connected to the first node, and another end of the first capacitor is electrically connected to the constant-voltage low-level signal.

5. The GOA circuit of claim 1, wherein the pull-down module comprises a fifth transistor, a sixth transistor, an eighth transistor, a tenth transistor, and a second capacitor;

a gate of the fifth transistor, a drain of the sixth transistor, a drain of the eighth transistor, a gate of the tenth transistor, and one end of the second capacitor are all electrically connected to a third node; a source of the fifth transistor, a source of the sixth transistor, a source of the tenth transistor, and another end of the second capacitor are all electrically connected to the constant-voltage low-level signal; a drain of the fifth transistor and a gate of the sixth transistor are both electrically connected to the first node; a gate of the eighth transistor is electrically connected to the second node, a source of the eight transistors is electrically connected to the constant-voltage high-level signal, and a drain of the tenth transistor is electrically connected to the scan signal output end.

6. The GOA circuit of claim 5, wherein the functional module comprises an eleventh transistor and a twelfth transistor;

a gate of the eleventh transistor is electrically connected to the first function control signal, a source of the eleventh transistor is electrically connected to the third function control signal, and a drain of the eleventh transistor is electrically connected to the third node; and a gate of the twelfth transistor is electrically connected to the second function control signal, a source of the twelfth transistor is electrically connected to the fourth function control signal, and a drain of the twelfth transistor is electrically connected to the scan signal output end.

7. The GOA circuit of claim 6, wherein the GOA circuit has a reset mode, an abnormal power-off mode, and a full shutdown mode;

when the GOA circuit is in the reset mode, the first function control signal and the third function control signal are at a high potential;

when the GOA circuit is in the abnormal power-off mode, the first function control signal, the second function control signal, and the fourth function control signal are all at the high potential, and the third function control signal is at a low potential; and when the GOA circuit is in the full-off mode, the second function control signal is at the high potential, and the fourth function control signal is at the low potential.

8. The GOA circuit of claim 1, wherein the GOA circuit accesses a first clock signal, a second clock signal, a third clock signal, and a fourth clock signal; and the (4k+1)th stage clock signal and the first clock signal are the same signal, the (4k+2)th stage clock signal and the second clock signal are the same signal, the (4k+3)th stage clock signal and the third clock signal are the same signal, the (4k+4)th stage clock signal and the fourth clock signal are the same signal, wherein k is greater than or equal to 0, and k is an integer.

9. The GOA circuit of claim 1, wherein the GOA circuit accesses a first start signal and a second start signal;

when the GOA circuit is in the forward scanning mode, the first-stage GOA unit accesses the first start signal, and the second-stage GOA unit accesses the second start signal; and when the GOA circuit is in the reverse scan mode, the GOA unit of an Nth stage accesses the first start signal, and the GOA unit of the (N−1)th stage accesses the second start signal.

10. A display panel, comprising a GOA circuit, the GOA circuit comprises N stage GOA units, and a n-th stage GOA unit comprises a forward scan control module, a reverse scan control module, a pull-up module, a pull-down module, and a function module, wherein $2<n<N-1$, and n and N are positive integers;

the forward scan control module is connected to a forward signal, an (n+1)th stage clock signal and an (n−2)th stage scan signal, and is electrically connected to a first node and a second node; the forward scan control module is configured to raise a potential of the first node and control a potential of the second node according to the forward signal, the (n+1)th stage clock signal, and the (n−2)th stage scan signal;

the reverse scan control module is connected to a reverse signal, an (n−1)th stage clock signal and an (n+2)th stage scan signal, and is electrically connected to the first node and the second node; the reverse scan control module is configured to raise the potential of the first node and control the potential of the second node according to the reverse signal, the (n−1)th stage clock signal, and the (n+2)th stage scan signa;

the pull-up module is connected to a constant-voltage low-level signal, a constant-voltage high-level signal, and an n-th stage clock signal, and is electrically connected to the first node and a scan signal output end; the pull-up module is configured to control a potential of the scan signal output end according to the constant-voltage low-level signal, the constant-voltage high-level signal, the n-th clock signal, and the potential of the first node;

the pull-down module is connected to the constant-voltage high-level signal and the constant-voltage low-level signal, and is electrically connected to the first node, the second node, and the scan signal output end; the pull-down module is configured to pull down the potential of the first node and the potential of the scan signal output end according to the constant-voltage high-level signal, the constant-voltage low-level signal, and the potential of the second section; and the function module is connected to a first function control signal, a second function control signal, a third function control signal, and a fourth function control signal, and is electrically connected to the pull-down module and the scan signal output end; the function module is configured to control the potential of the first node and the potential of the scan signal output end according to the first function control signal, the second function control signal, the third function control signal and the fourth function control signal.

11. The display panel of claim 10, wherein the forward scan control module comprises a first transistor and a third transistor;

a gate of the first transistor is electrically connected to the (n−2)th scan signal, and a source of the first transistor is electrically connected to the forward scan signal and a gate of the third transistor, a drain of the first transistor is electrically connected to the first node, a source of the third transistor is electrically connected to the (n+1)th stage clock signal, and a drain of the third transistor is electrically connected to the second node.

12. The display panel of claim 10, wherein the reverse scan control module comprises a second transistor and a fourth transistor;

a gate of the second transistor is electrically connected to the (n+2)th scan signal, and a source of the second transistor is electrically connected to the reverse scan signal and a gate of the fourth transistor, a drain of the second transistor is electrically connected to the first node, a source of the fourth transistor is electrically connected to the (n−1)th stage clock signal, and a drain of the fourth transistor is electrically connected to the second node.

13. The display panel of claim 10, wherein the pull-up module comprises a seventh transistor, a ninth transistor, and a first capacitor;

a gate of the seventh transistor is electrically connected to the constant-voltage high-level signal, a source of the seventh transistor is electrically connected to the first node, and a drain of the seventh transistor is electrically connected to a gate of the ninth transistor, the gate of the ninth transistor is electrically connected to the n-th clock signal, and the gate of the ninth transistor is electrically connected to the scan signal output end; one end of the first capacitor is electrically connected to the first node, and another end of the first capacitor is electrically connected to the constant-voltage low-level signal.

14. The display panel of claim 10, wherein the pull-down module comprises a fifth transistor, a sixth transistor, an eighth transistor, a tenth transistor, and a second capacitor;

a gate of the fifth transistor, a drain of the sixth transistor, a drain of the eighth transistor, a gate of the tenth transistor, and one end of the second capacitor are all electrically connected to a third node; a source of the fifth transistor, a source of the sixth transistor, a source of the tenth transistor, and another end of the second capacitor are all electrically connected to the constant-voltage low-level signal; a drain of the fifth transistor and a gate of the sixth transistor are both electrically connected to the first node; a gate of the eighth transistor is electrically connected to the second node, a source of the eight transistors is electrically connected to the constant-voltage high-level signal, and a drain of the tenth transistor is electrically connected to the scan signal output end.

15. The display panel of claim 14, wherein the functional module comprises an eleventh transistor and a twelfth transistor;

a gate of the eleventh transistor is electrically connected to the first function control signal, a source of the eleventh transistor is electrically connected to the third function control signal, and a drain of the eleventh transistor is electrically connected to the third node; and a gate of the twelfth transistor is electrically connected to the second function control signal, a source of the twelfth transistor is electrically connected to the fourth function control signal, and a drain of the twelfth transistor is electrically connected to the scan signal output end.

16. The display panel of claim 15, wherein the GOA circuit has a reset mode, an abnormal power-off mode, and a full shutdown mode;

when the GOA circuit is in the reset mode, the first function control signal and the third function control signal are at a high potential;

when the GOA circuit is in the abnormal power-off mode, the first function control signal, the second function control signal, and the fourth function control signal are all at the high potential, and the third function control signal is at a low potential; and when the GOA circuit is in the full-off mode, the second function control signal is at the high potential, and the fourth function control signal is at the low potential.

17. The display panel of claim 10, wherein the GOA circuit accesses a first clock signal, a second clock signal, a third clock signal, and a fourth clock signal; and the (4k+1)th stage clock signal and the first clock signal are the same signal, the (4k+2)th stage clock signal and the second clock signal are the same signal, the (4k+3)th stage clock signal and the third clock signal are the same signal, the (4k+4)th stage clock signal and the fourth clock signal are the same signal, wherein k is greater than or equal to 0, and k is an integer.

18. The display panel of claim 10, wherein the GOA circuit accesses a first start signal and a second start signal;

when the GOA circuit is in the forward scanning mode, the first-stage GOA unit accesses the first start signal, and the second-stage GOA unit accesses the second start signal; and when the GOA circuit is in the reverse scan mode, the GOA unit of an Nth stage accesses the first start signal, and the GOA unit of the (N−1)th stage accesses the second start signal.

* * * * *